United States Patent [19]

Khoury

[11] Patent Number: 4,555,861

[45] Date of Patent: Dec. 3, 1985

[54] FIRING PIN LOCKING DEVICE

[75] Inventor: Donald S. Khoury, Granby, Mass.

[73] Assignee: Colt Industries Operating Corp, West Hartford, Conn.

[21] Appl. No.: 562,086

[22] Filed: Dec. 16, 1983

[51] Int. Cl.[4] ..... F41C 19/00; F41C 17/04

[52] U.S. Cl. ..... 42/70 F; 42/69 R

[58] Field of Search ..... 42/66, 70 F; 42/65, 42/69 R, 69 B; 89/154

[56] References Cited

U.S. PATENT DOCUMENTS

| | | | |
|---|---|---|---|
| 1,972,763 | 9/1934 | Dutton | 42/70 F |
| 2,169,084 | 8/1939 | Swartz | 89/154 |
| 2,846,925 | 8/1958 | Norman | 42/70 F |
| 3,633,303 | 1/1972 | Volkmar et al. | 42/70 F |
| 3,724,113 | 4/1973 | Ludwig | 42/70 F |
| 3,830,002 | 8/1974 | Volkmar | 42/70 F |
| 4,021,955 | 5/1977 | Curtis | 42/70 F |
| 4,306,487 | 12/1981 | Beretta | 42/70 F |
| 4,312,263 | 1/1982 | Bourlet | 42/70 F |

FOREIGN PATENT DOCUMENTS

| | | | |
|---|---|---|---|
| 660046 | 10/1951 | United Kingdom | 42/70 F |

OTHER PUBLICATIONS

"Colt MK IV Series 80 Pistol", *American Rifleman,* Sep. 1983, pp. 59–60.

*Primary Examiner*—Charles T. Jordan
*Assistant Examiner*—Ted L. Parr
*Attorney, Agent, or Firm*—Radford W. Luther; Richard A. Dornon

[57] ABSTRACT

A semi-automatic pistol (10) has a breech-slide (14) for chambering a cartridge (32). The breech-slide carries an inertia type firing pin (18) which is displaced to fire the chambered cartridge by a hammer (26). An axially movable trigger assembly (42) functions to displace a sear (34) to release the hammer when the trigger assembly is moved to the pulled position. The hammer has a safety surface (46) which performs the function of a half-cocked notch but engages the sear near the fired position so that a falling of the hammer after disengagement of the sear and the safety surface will not cause the firing pin to fire a cartridge. A firing pin lock (20) is mounted in the breech-slide for vertical movement between a lower pin-locking position and an upper position in which the pin is free to travel. A pair of operatively interconnected levers (70, 76) respond to movement of the trigger assembly to the pulled position and simultaneously move the lock to the upper position.

5 Claims, 10 Drawing Figures

FIRING PIN LOCKING DEVICE

TECHNICAL FIELD

This invention relates to safety devices for firearms and more particularly to firing pin safety arrangements for semi-automatic pistols intended to prevent inadvertent firing pin displacements as could be occasioned by a forceful dropping of the pistol or a falling of the hammer from the half-cocked position.

BACKGROUND ART

Conventional semi-automatic pistols can be accidently fired under extraordinary circumstances when the firing pin is forcefully displaced either by the hammer or its own inertia. For example, it might be possible to fire a semi-automatic pistol in the cocked condition by forcibly striking the pistol on its hammer or its muzzle. The prior art has addressed the aforementioned problem and examples of firing pin locking devices are disclosed in U.S. Pat. Nos. 2,846,925; 3,724,113; 3,830,002; and 4,021,955 and British Pat. Specification No. 660,046. However, the devices shown in the aforementioned patents are not suitable for incorporation into the most popular semi-automatic pistols which are similar in design to the Colt 1911 and 1911A1models.

In addition, conventional semi-automatic pistols incorporate a hammer having a half-cocked notch with a lip which can engage the tip of the sear although such a possibility is extremely unlikely. If an engagement of this nature occurs, the hammer could possibly fall from the half-cocked position and discharge the firearm.

DISCLOSURE OF THE INVENTION

In accordance with the invention, there is provided a firing pin locking device, adapted for use in the predominant type of semi-automatic pistol (i.e., Colt M1911, M1911A1 automatic and variations and copies thereof) which includes a firing pin lock slideably mounted on the breech-slide. The firing pin lock is positioned by a double lever arrangement in order to maximize movement and leverage while accommodating dimensional variations in the firing mechanism. In addition, the surface of the firing pin which the lock is adapted to engage, is generally conical whereby minor timing deviations in the locking device which occur due to wear and use will not adversely affect the locking and unlocking of the firing pin.

The invention also provides a hammer devoid of a conventional half-cocked notch but which instead is provided with a safety surface. The safety surface performs the same function as the half-cocked notch but positions the hammer much nearer the fired position whereby a falling of the hammer therefrom will not result in discharge of the firearm.

Accordingly, it is a primary object of the invention to provide a firing pin locking device for the prevailing type of semi-automatic pistol.

Another object is to provide a hammer for a semi-automatic pistol which will not discharge the pistol after falling from the half-cocked position.

These and other objects and advantages of the invention will become more readily apparent from the following detailed description when taken in conjunction with the accompanying drawings, in which:

BEST MODE OF CARRYING OUT THE INVENTION

Figure 1:
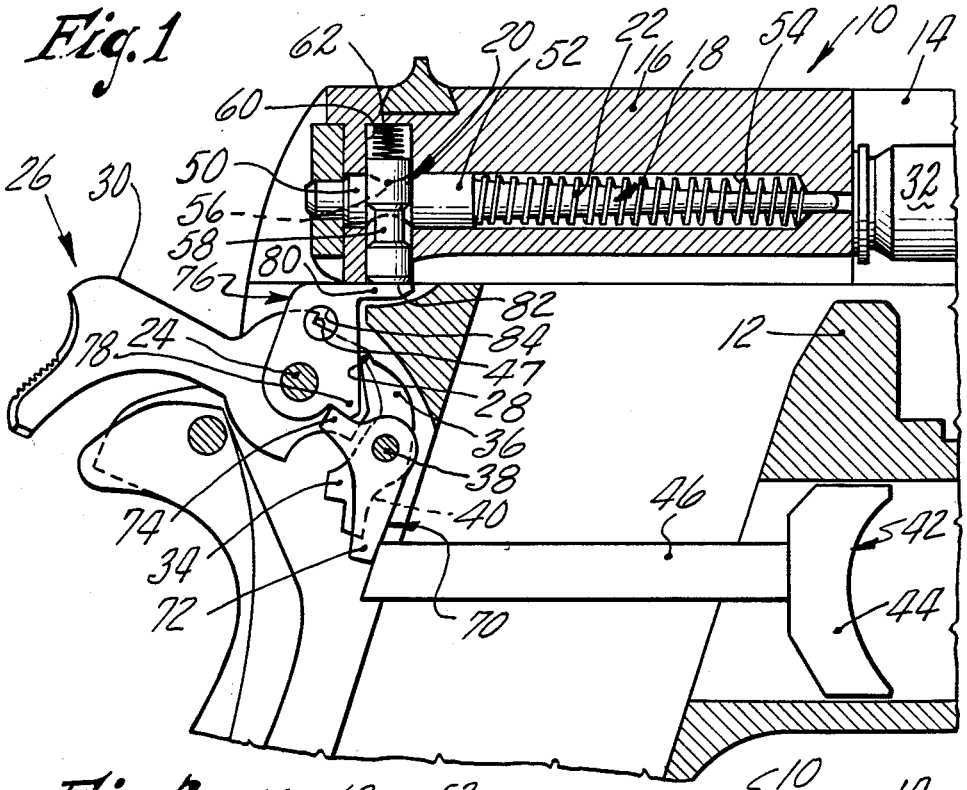
FIG. 1 is a fragmentary, side elevational, sectional view of a semi-automatic firearm according to the invention with the firing mechanism thereof in the full-cocked condition and the trigger in its forward or unpulled position.
Figure 2:
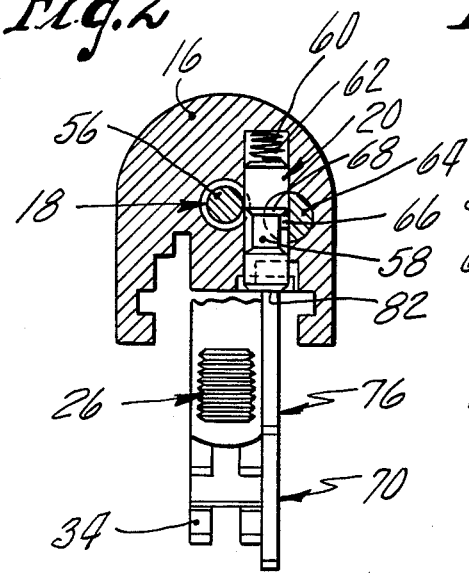
FIG. 2 is a fragmentary, rear elevational sectional view of the firearm of FIG. 1.

Turning now to the drawings, wherein similar numerals refer to similar parts throughout the several figures, an illustrative firearm, in the form of a semi-automatic pistol which is similar to the Colt 1911 model is depicted. With particular reference to FIGS. 1 and 2, there is shown a semi-automatic pistol 10 having a frame 12 with a barrel (not shown) mounted thereupon for limited double movement in the usual manner. A breech-slide or bolt-carrier 14 is also mounted upon the frame 12 for sliding reciprocating movement thereover between forward (battery) and rearward (recoil) positions. The rear portion of the breech-slide 14 is constituted by a breech-bolt 16 which includes the usual shell extractor at its forward end. The breech-bolt incorporâtes a firing pin 18 which is adapted to be locked or have its forward path of travel obstructed by a sliding lock 20, as is discussed hereinafter in more detail. The firing pin 18 is urged rearwardly by a spring 22.

Mounted upon the frame 12 for pivoting movement on a pin 24 between cocked and fired positions is a hammer 26. The hammer 26 is biased toward the fired position by a spring-loaded lever (not shown) whose upper end is seated upon a pin (not shown) in the hammer 26. In typical fashion, the hammer 26 is provided with a searing surface 28. The face 30 of the hammer 26 is adapted to strike the rear end of the firing pin 18 for applying forward momentum thereto such that the front end thereof may strike the primer of a cartridge 32 chambered in the breech end of the barrel with sufficient velocity to fire the cartridge. During recoil the hammer 26 is cocked in the usual manner by the rearward movement of the breech-slide 14.

A sear 34, which has a tang 36 for engaging searing surface 28, is pivotally mounted upon the frame 12 by means of pin 38. When the hammer is cocked the upper surface of the tang 36 engages the searing surface 28 of the hammer 26. The lower portion of the sear 34 embodies a surface 40 which is adapted to be contacted by a disconnect (not shown) for producing a pivoting movement of the sear to release the hammer for falling movement. The sear is biased in a counter-clockwise direction by a leaf spring (not shown) secured to the grip portion of the frame.

Figure 3:
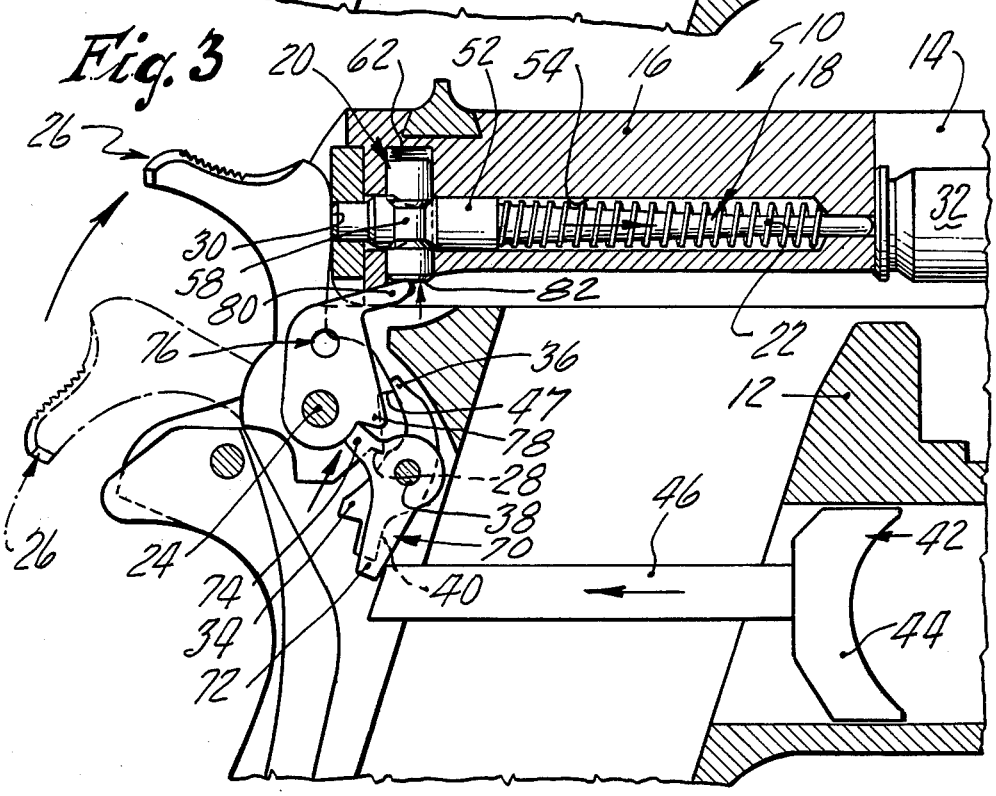
FIG. 3 is a view similar to that of FIG. 1 showing the firing mechanism in the trigger pulled position subsequent to hammer fall.

A trigger assembly 42 is mounted upon the frame 12 for axial sliding movement between a normal or unpulled position and a pulled position. The trigger assembly comprises a trigger 44 and the usual bifurcated trigger bar 46 integral therewith which engages the disconnect (not shown) to rotate the sear 34 clockwise about the pin 38. The trigger assembly 42 is biased towards its normal or forward position by the sear spring (not shown), the force of which is transmitted through the sear 34 and the disconnect (not shown). When the trigger 44 is pulled, as shown in FIG. 3, the sear 34 pivots in a clockwise sense to release the hammer for falling movement from the cocked position to the fired position.

Figure 6:
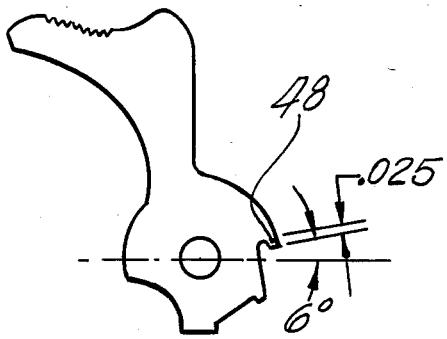
Fig. 6 (PRIOR ART)
FIG. 6 is a view of a typical prior art hammer.
Figure 7:
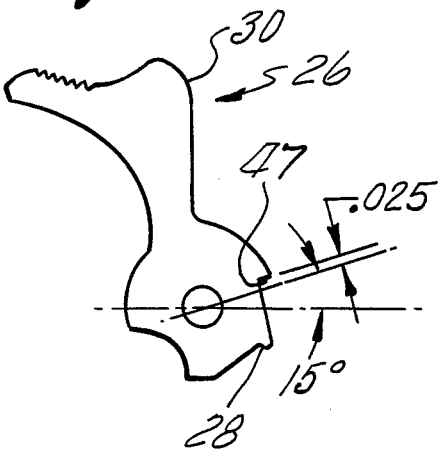
FIG. 7 is a side elevational view of a hammer of the invention which is embodied in the firearm of FIG. 1.

It will be noted that the hammer 26, which is best shown in FIG. 7, is devoid of the conventional half-cocked notch illustrated in FIG. 6 but instead embodies shelf-like flat surface 47 on its lower periphery which functions as a safety stop. Surface 46 is adapted to engage the tang 36 of the sear 34 in the unlikely event of the tang 36 becoming unintentionally disengaged from (i.e., searing surface fall off) or failing to engage the searing surface 28 of the hammer 26 to thereby prevent hammer fall to the fired position or uncontrolled automatic fire. Surface 47 also acts to prevent the hammer from striking the firing pin should a user's hand slip from the slide or hammer while the pistol 10 is being cocked, provided however, that the surface 47 is rotated past the tang 36.

It is, of course, possible to disengage the surface 47 from the tang 36 by pulling the trigger. However, the surface 47 is located such that, upon disengagement from the tang 36, the hammer will undergo only a small rotational movement in its falling movement to the fired position whereby the hammer will not have attained a sufficient velocity to move the firing pin into a chambered cartridge. As shown in FIGS. 6 and 7, the surface 47 is angularly displaced about nine degrees in the counterclockwise direction from where a conventional half-cocked notch 48 would be disposed.

Figure 5:
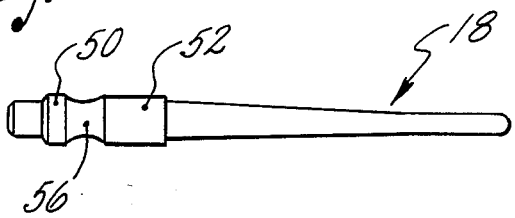
FIG. 5 is a side elevational view of the firing pin, per se.
Figure 8:
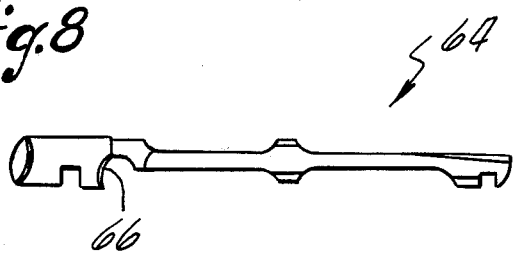
FIG. 8 is a top plan view of the shell extractor, per se.
Figure 10:
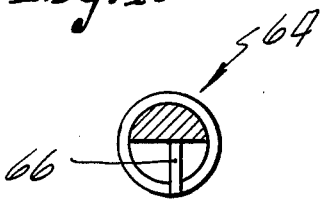
FIG. 10 is a sectional view of the shell extractor taken along the line 10—10 of FIG. 9.
Figure 9:
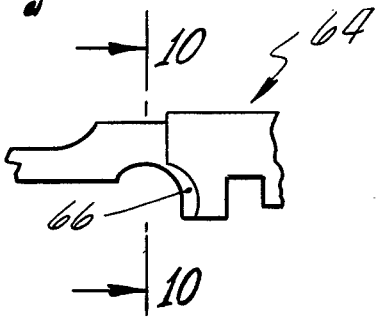
FIG. 9 is an enlarged fragmentary view of the shell extractor of FIG. 8 showing the rib thereupon which retains the firing pin lock in the movement preventing position.

Firing pin 18, which is shown alone in FIG. 5 comprises two lands, 50 and 52 which serve to guide the reciprocating sliding movement thereof in its cavity 54 in the breech-bolt 16 between firing and retracted positions. The lands 50 and 52 of the firing pin 18 are interconnected by a segment 56 thereof which is generally hourglass-shaped and defines an annular volume whereby the lock 20 may engage a generally conical rear surface of the segment at a plurality of axial stations on the firing pin in order to lock the firing pin. Since the locking relationship between the lock and the firing pin is based on contact with a surface of progressively increasing diameter, minor timing deviations in the lock work due to wear and use will not adversely affect this relationship.

Figure 4:
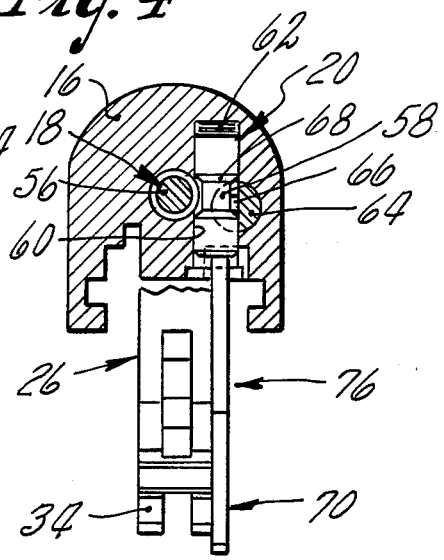
FIG. 4 is a fragmentary, rear elevational sectional view of the firearm in the condition depicted in FIG. 3.

The sliding lock 20 is a generally cylindrical pin having a reduced diameter inboard segment 58 which defines an annular volume through which the land 50 may travel in an unimpeded manner. The lock 20 is mounted for vertical sliding movement in a vertical bore 60 in breech-bolt 16 between a lower pin movement preventing position and an upper pin movement permitting position. The bore 60 intersects the cavity 54 such that a portion of the lock 20 travels in the cavity, as is best shown in FIGS. 2 and 4. As shown in FIGS. 1 and 2, when the lock 20 is in its lower position the upper portion of the lock 20, which comprises an abutment surface, is adapted to contact the rear of the hourglass-shaped segment 56 to obstruct forward movement of the firing pin 18. A compression spring 62 interposed between the upper surface of the lock 20 and the base of the bore 60 urges the lock downwardly and maintains it in the movement preventing position wherein the path of movement of the firing pin 18 is blocked.

Obviously, a means must be furnished to retain the lock 20 in the bore 60 against the urging of spring 62. To this end, it has been found that it is unnecessary to provide a pin or other form of stop since, with a minor modification, the shell extractor can perform this function. As shown in FIGS. 2, 4, 8, 9 and 10, a conventional shell extractor 64 has an arcuate rib 66 fashioned thereupon which is received within the annular volume defined by segment 58 of the lock 20 such that the base 68 of the upper portion of the lock 20 is in abutting relationship therewith whereby the downwardly urged lock 20 is retained in its bore.

Unlocking of the firing pin 18 is achieved by a pulling of the trigger which operates a system of levers. With reference to FIG. 1, a first lever 70, having arms 72 and 74, is mounted for rotation upon the sear pin 38 withits arm 72 in engagement with the trigger bar 46. A second lever 76, having arms 78 and 80, is mounted for rotation upon the hammer pin 24 with its arm 78 in engagement with the arm 74 of the first lever 70 and its arm 80 in closely spaced relationship to the undersurface 82 of the lock 20. The second lever 76 also incorporates a work hole 84 to break any suction between the frame 12 and the second lever 76. When the trigger 44 is pulled to the pulled position of FIGS. 3 and 4, the trigger bar 46 moves rearwardly resulting in a clockwise rotation of the lever 70 and a counterclockwise rotation of the lever 76 by virtue of the engagement between the arms 74 and 78. A counterclockwise rotation of the lever 76 results in the arm 80 lifting the lock 20 to its upper pin movement permitting position. Conversely, releasing the pulled trigger 44 results in downward movement of the lock 20 under the bias of the spring 62 to the lower pin movement preventing position.

An understanding of the operation of the illustrated semi-automatic pistol can best be attained by reference to FIGS. 1, 2, 3 and 4. First, a loaded magazine (not shown) is inserted in the grip portion of the frame 12. A cartridge from the magazine is then chambered by rearwardly displacing the breech-slide 14 and moving the breech-slide 14 back to its forward position. The elements of the firing mechanism are now in the respective positions depicted in FIGS. 1 and 2.

In order to fire the chambered cartridge 32, it is necessary that the trigger 44 be pulled or depressed to the position illustrated in FIG. 3. This action pivots the sear 34, thereby disengaging the sear 34 from the hammer searing surface 36 which permits the hammer to fall from its cocked position shown in phantom in FIG. 3 to the fired position thereof. As the trigger 44 is depressed, the first lever 70 is pivoted by the trigger bar 46 which action results in a consequential pivoting of the second lever 76. As the second lever is pivoted, the lock 20 is driven upwardly by the arm 80 from its lower movement preventing position of FIGS. 1 and 2 to its upper movement permitting position of FIGS. 3 and 4 such that the firing pin 18 is unlocked just before sear 34 disengages from the hammer 26 whereby the impetus of the hammer 26 will drive the firing pin 18 to the firing position.

Upon striking and firing the chambered cartridge 32, the firing pin 18 will rebound to the position of FIG. 3. The breech-slide 14 now moves rearwardly carrying the spent cartridge in the shell extractor 64. Rearward movement of the breech-slide 14 causes the hammer to be driven downwardly to a position just beyond its cocked position. As the breech-slide 14 returns to the battery position under the urging of the operating spring (not shown), the sear 34 engages the searing surface 28 of the hammer as the hammer rotates a few degrees in the clockwise direction.

During rearward movement of the breech-slide 14, the undersurface 82 of the lock 20 will clear the arm 80 of the second lever 76, thereby causing the lock 20 to be driven downwardly to its lower movement preventing position by the spring 62. The lock 20 will, of course, remain in this position during further rearward and subsequent forward breech-slide movement until its undersurface 82 again engages the arm 80 as the breech-slide 14 moves into battery position. As the breech-slide 14 again assumes its battery position, the engagement between the arm 80 and the undersurface 82 of the lock 20 will result in upward movement of the lock 20 to its upper movement permitting position assuming the trigger 44 is held in its pulled position. When the trigger 44 is released, second lever 76 will be rotated clockwise by the lock 20 which moves downwardly to its movement preventing position under the urging of the spring 62. The pistol may now be discharged by again pulling the trigger.

From the above, it will be appreciated that the firing pin 18 is locked against forward movement under all circumstances except when the trigger is pulled and the breech-slide is in battery position.

Obviously, many modifications and variations are possible in light of the above teachings without departing from the scope and spirit of the invention, as defined in the subjoined claims.

What is claimed is:

1. In an improved firearm of the type comprising:

a frame having a hammer pin and a sear pin;

a breech-slide mounted on the frame for sliding movement between forward and rearward positions;

a firing pin mounted in the breech-slide for travel between firing and retracted positions;

a hammer, having a searing surface thereupon, mounted on the frame upon the hammer pin for pivoting movement between cocked and fired positions, the hammer being adapted to strike the firing pin as it moves into the fired position for causing the pin to engage a chambered cartridge and being adapted to be cocked by the breech-slide as it moves rearwardly;

a trigger assembly, having a trigger and a trigger bar integral therewith, mounted on the frame for axial sliding movement between normal and pulled positions;

a sear pivotally mounted on the frame upon the sear pin for engaging the searing surface of the hammer such that it may be retained in the cocked position, the rearward movement of the bar serving to displace the sear to occasion disengagement with the searing surface of the hammer, whereby the hammer may fall to the fired position; and wherein the improvement comprises:

a firing pin lock, having an abutment surface thereupon, slideably mounted on the breech-slide for sliding movement between an upper movement permitting position in which travel of the firing pin from the retracted position to the firing position is unimpeded and a lower movement preventing position in which the abutment surface is adapted to engage and obstruct the firing pin during travel toward the firing position;

means to bias the lock toward the movement preventing position;

means to retain the lock in the movement preventing position;

a first lever mounted for rotation upon the sear pin in operative connection with the trigger bar such that axial movement of the trigger assembly produces a corresponding rotation of the first lever;

a second lever mounted for rotation upon the hammer pin in operative connection with the lock and the first lever such that rotation of the second lever in a first direction produces a movement of the lock from the movement preventing position toward the movement permitting position and subsequent rotation of the second lever in a second direction opposite to the first direction produces a movement of the lock toward the movement preventing position, the second lever being in operative connection with the first lever such that rotation of the first lever in response to movement of the trigger assembly from the normal position to the pulled position produces a rotation of the second lever in the first direction which results in movement of the lock from the movement preventing position to the movement permitting position.

2. The improvement of claim 1, wherein the firearm is of the type further comprising:

an extractor mounted in the breech-bolt for withdrawing a spent chambered cartridge; and wherein the retaining means comprises:

a rib on the shell extractor in abutting relationship with the lock when the lock occupies its movement preventing position.

3. The improvement of claim 1, wherein the firing pin includes two lands having an interconnecting segment therebetween which defines an annular volume, the interconnecting segment having a generally conical rear surface for engaging the lock upon firing pin travel toward the firing position.

4. The improvement of claim 1, wherein the hammer comprises:

a shelf-like flat surface on its lower periphery for engaging the sear such that the hammer may be retained in a half-cocked position, the flat surface being disposed on the hammer at a location where the hammer will undergo only a small rotational movement to the fired position upon disengagement of the sear and the flat surface whereby the firing pin will not engage and fire a cartridge.

5. In an improved firearm of the type comprising:

a frame;

a breech-slide mounted on the frame for sliding movement between forward and rearward positions;

a firing pin mounted in the breech-slide for travel between firing and retracted positions;

a hammer, having a searing surface thereupon, mounted on the frame for movement between cocked and fired positions, the hammer being adapted to strike the firing pin as it moves into the fired position for causing the pin to engage a chambered cartridge and being adapted to be cocked by the breech-slide as it moves rearwardly;

a sear movably mounted on the frame for engaging the searing surface of the hammer such that it may be retained in the cocked position, displacement of the sear occasioning disengagement with the searing surface of the hammer, whereby the hammer may fall to the fired position; and wherein the improvement comprises:

the hammer having a shelf-like flat surface on its lower periphery for engaging the sear such that the hammer may be retained in the event of a searing surface fall off, the flat surface being disposed on the hammer at a location where the hammer will undergo only a small rotational movement to the fired position upon disengagement of the sear and the flat surface whereby the firing pin will not engage and fire a cartridge.

* * * * *